US010739101B2

(12) United States Patent
Jacobson

(10) Patent No.: US 10,739,101 B2
(45) Date of Patent: Aug. 11, 2020

(54) FIREARM SUPPORT DEVICE

(71) Applicant: Revo Brand Group, LLC, Plymouth, MN (US)

(72) Inventor: Ryan Jacobson, Minneapolis, MN (US)

(73) Assignee: Revo Brand Group, LLC, Plymouth, MN (US)

( * ) Notice: Subject to any disclaimer, the term of this patent is extended or adjusted under 35 U.S.C. 154(b) by 0 days.

Patent file contains an affidavit/declaration under 37 CFR 1.130(b).

(21) Appl. No.: 16/545,779

(22) Filed: Aug. 20, 2019

(65) Prior Publication Data

US 2020/0141683 A1 May 7, 2020

Related U.S. Application Data

(60) Provisional application No. 62/724,279, filed on Aug. 29, 2018.

(51) Int. Cl.
*F41A 23/18* (2006.01)
*F41A 11/00* (2006.01)

(52) U.S. Cl.
CPC ..... *F41A 23/18* (2013.01); *F41A 11/00* (2013.01)

(58) Field of Classification Search
CPC ..... F41A 23/18; F41A 23/16; F41A 11/00; F41A 31/00; F41A 31/02; F41A 35/00
USPC ..... 42/94
See application file for complete search history.

(56) References Cited

U.S. PATENT DOCUMENTS

| | | | | |
|---|---|---|---|---|
| 5,419,540 | A * | 5/1995 | Teafatiller | B25B 1/2463 269/261 |
| 9,372,041 | B1 * | 6/2016 | Geissele | F41A 11/00 |
| D768,254 | S | 10/2016 | Geissele | |
| 9,506,711 | B2 | 11/2016 | Gomez | |
| 9,816,546 | B2 | 11/2017 | Gomez | |
| 2014/0075817 | A1 | 3/2014 | Gomez | |
| 2016/0202008 | A1 * | 7/2016 | Geissele | F41A 35/00 42/108 |

(Continued)

OTHER PUBLICATIONS

NPL: https://gunmagwarehouse.com/blog/real-avid-new-ar-building-tools-shot-show-2018/ Jan. 29, 2018, pp. 9-12.*

(Continued)

*Primary Examiner* — John Cooper
(74) *Attorney, Agent, or Firm* — Grumbles Law PLLC; Brittany Nanzig

(57) ABSTRACT

A firearm support device can include an elongate member, a lock knob, and vise pins. The elongate member can include a clamping portion, a supporting portion, and a stop portion located therebetween. The clamping portion can be clamped between jaws of a bench vise, can include two parallel clamping faces, and can define vise pin holes. The vise pins can be received by the vise pin holes. The supporting portion can support an upper receiver of a firearm and can include a cylindrical shaft aligned with the long axis of the elongate member. The supporting portion can include splines structured to mate with lugs of a barrel extension of a firearm barrel. The supporting portion can define a plurality of lock knob holes aligned radially and located around the cylindrical shaft. The lock knob can be received by one of these holes and constrain the upper receiver.

12 Claims, 4 Drawing Sheets

(56) References Cited

U.S. PATENT DOCUMENTS

2017/0108303 A1 4/2017 Gomez

OTHER PUBLICATIONS

Gomez, Jesus S.; Application History of U.S. Pat. No. 9,816,546; USPTO Communication; 353 pp.

* cited by examiner

FIREARM SUPPORT DEVICE

CROSS-REFERENCE TO RELATED APPLICATION

This application claims the benefit of U.S. Provisional Patent Application Ser. No. 62/724,279, filed Aug. 29, 2018 and titled FIREARM SUPPORT DEVICE, which is herein incorporated by reference in its entirety.

FIELD OF THE INVENTION

This disclosure relates to firearm maintenance aids, and more particularly, relates to vise support devices for firearm maintenance.

BACKGROUND OF THE INVENTION

During maintenance activities, firearms such as rifles (or sub-components thereof) are often held or otherwise supported by clamps, jigs, vises, or other mechanical support arrangements. This can free up an armorer's hands for performing maintenance tasks and can enable greater application of torque to firearm components than, for example, handholding. In some cases, however, an armorer can clamp a firearm component into a vise in such a way that the component may be damaged. It would be desirable to provide vise support devices for firearm maintenance that can provide secure support for firearm components with minimal or no risk of damaging said components as a result of clamping.

SUMMARY OF THE INVENTION

This disclosure relates to firearm maintenance aids, and more particularly, relates to vise support devices for firearm maintenance. In an illustrative but non-limiting example, the disclosure provides a firearm support device that can include an elongate member having a long axis, a lock knob, and at least two vise pins. The elongate member can include a clamping portion, a supporting portion, and a stop portion located between and structurally connecting the clamping portion and the supporting portion. The clamping portion can be structured and configured to be clamped between jaws of a bench vise and can include two parallel clamping faces on opposite sides of the clamping portion. The clamping portion can define a plurality of vise pin holes that can extend between the clamping faces. The supporting portion can be structured and configured to provide support to an upper receiver of a firearm and can include a generally cylindrical shaft aligned with the long axis of the elongate member. The supporting portion can further include, at a barrel end of the supporting portion, a plurality of splines structured and configured to mate with lugs of a barrel extension of a barrel of the firearm. The supporting portion can define a plurality of lock knob holes aligned radially and located circumferentially around the generally cylindrical shaft. The lock knob can include a boss structured and configured to be received by any of the plurality of lock knob holes located around the shaft of the supporting portion. The vise pins can be structured and configured to be received by any of the plurality of vise pin holes of the clamping portion.

In some examples, the stop portion can include a generally-planar upper receiver stop face that faces the supporting portion and is perpendicular to the long axis of the elongate member. This upper receiver stop face can be configured to prevent translation of an upper receiver toward the clamping portion of the device when a back side of the upper receiver bears against the upper receiver stop face.

In some examples, the lock knob holes can be located at substantially identical distances from the upper receiver stop face, such that when the back side of the upper receiver bears against the upper receiver stop face, and when the boss of the lock knob projects through the opening on the underside of the upper receiver and is received by one of the lock knob holes, the lock knob is positioned to prevent translation of the upper receiver away from the clamping portion of the device.

The above summary is not intended to describe each and every example or every implementation of the disclosure. The Description that follows more particularly exemplifies various illustrative embodiments.

BRIEF DESCRIPTION OF THE DRAWINGS

The following description should be read with reference to the drawings. The drawings, which are not necessarily to scale, depict examples and are not intended to limit the scope of the disclosure. The disclosure may be more completely understood in consideration of the following description with respect to various examples in connection with the accompanying drawings, in which.

DETAILED DESCRIPTION

Figure 1:
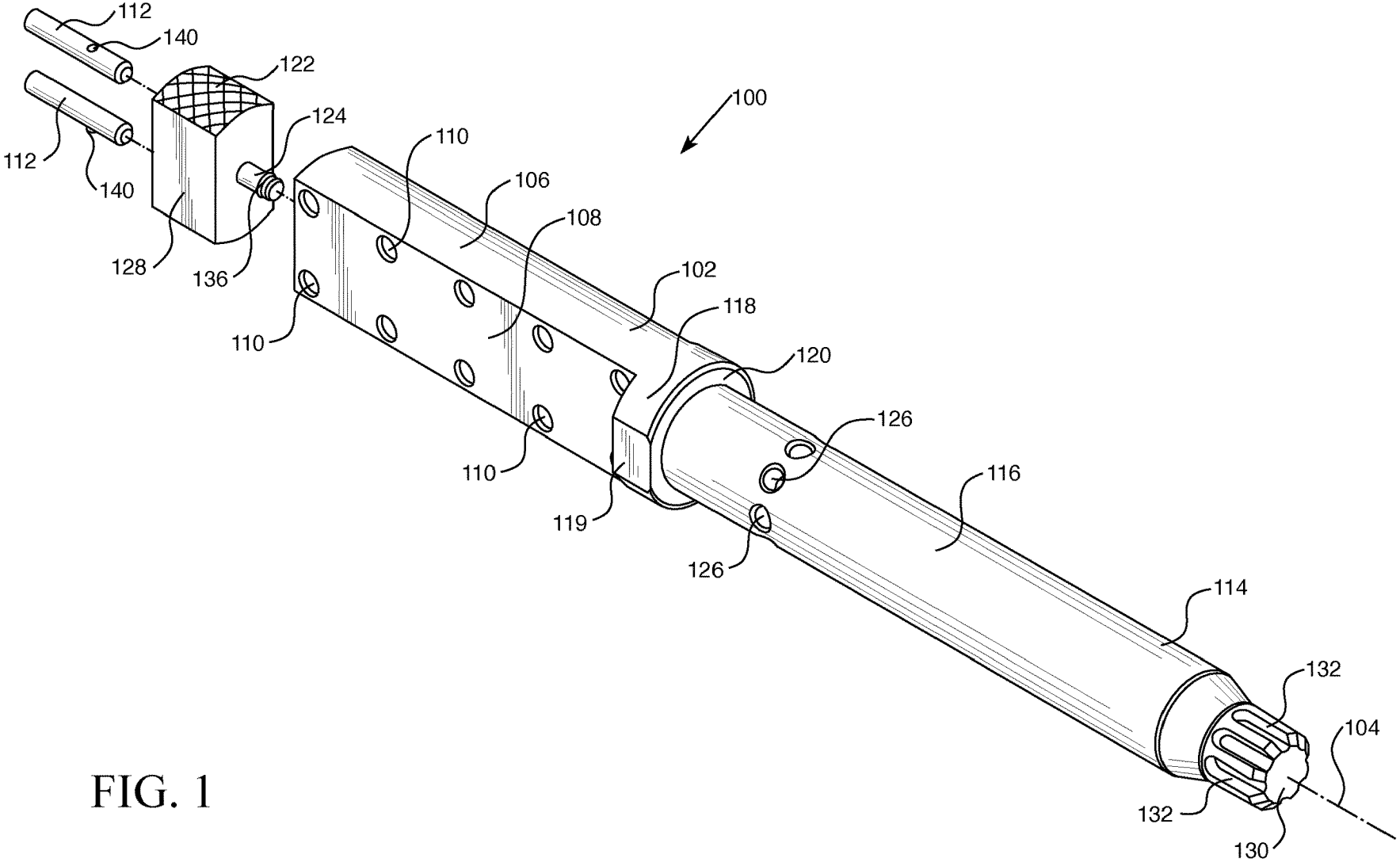
FIG. 1 is a schematic perspective view of an illustrative example of a firearm support device.

The present disclosure relates to firearm maintenance aids, and more particularly, relates to vise support devices for firearm maintenance. Various embodiments are described in detail with reference to the drawings, in which like reference numerals may be used to represent like parts and assemblies throughout the several views. Reference to various embodiments does not limit the scope of the systems and methods disclosed herein. Examples of construction, dimensions, and materials may be illustrated for the various elements, those skilled in the art will recognize that many of the examples provided have suitable alternatives that may be utilized. Any examples set forth in this specification are not intended to be limiting and merely set forth some of the many possible embodiments for the systems and methods. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

The present disclosure relates to support devices for firearms, including AR-15 type rifles. U.S. Pat. No. 9,372,041 provides a general description of a firearm that may be an AR-15 type rifle in FIGS. 1, 2, and 3, and from column 2, line 47 to column 5, line 32. These portions of U.S. Pat. No. 9,372,041 are hereby incorporated by reference into the present disclosure, to the extent that they do not contradict any portion of the instant disclosure.

Various known firearm maintenance support devices demonstrate shortcomings that limit their usefulness. Some known devices involve clamping the upper receiver of a rifle such as an AR-15, which can subject the upper receiver to forces that it is not intended or designed to bear, potentially resulting in damage to the component. Other devices exist, such as that described in U.S. Pat. No. 9,372,041, that themselves are clamped into a vise, and the firearm components are mounted to the device. Some of these devices only provide for supporting the firearm components in very specific or limited orientations, and some such devices only include minimal features to accommodate clamping by a vise. The present disclosure provides firearm support devices that can robustly and flexibly support firearm components in various orientations according to a user's preference, and that provide accessories that assist in vise clamping of the device.

Figure 2:
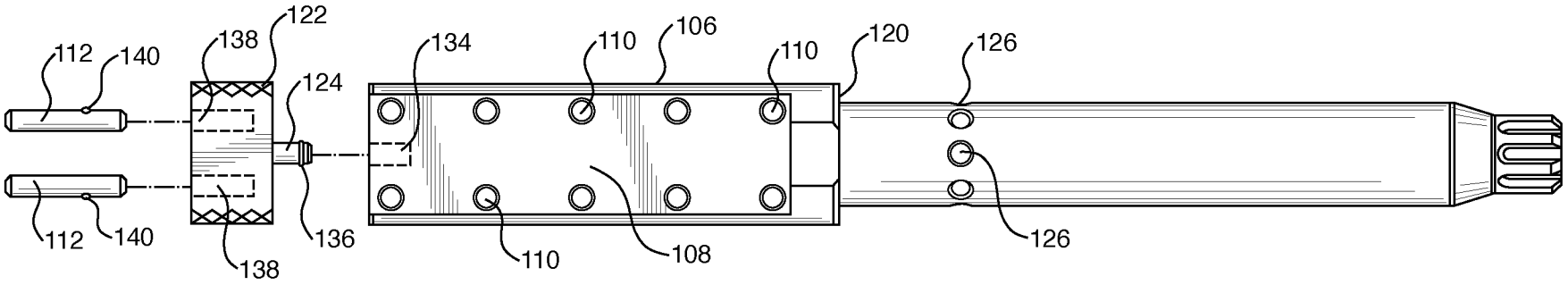
FIG. 2 is a schematic plan view of the firearm support device of FIG. 1.
Figure 3:
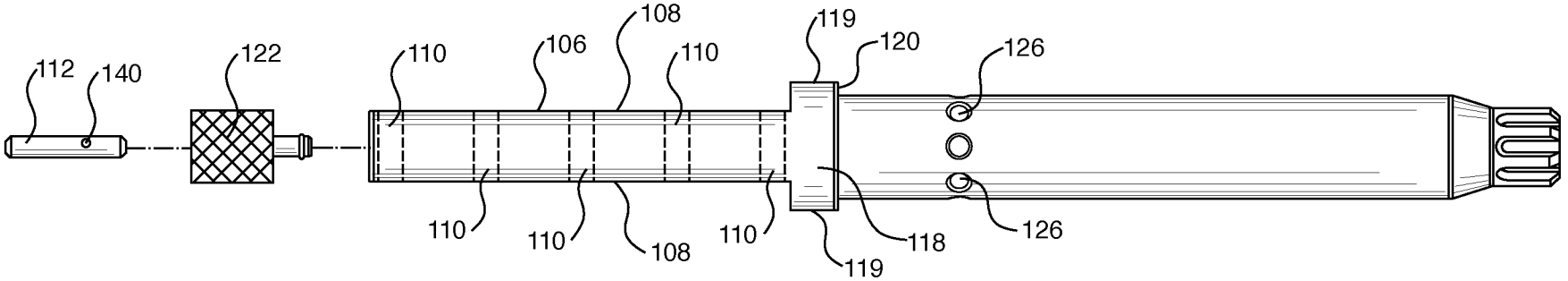
FIG. 3 is a schematic side view of the firearm support device of FIG. 1.

FIG. 1 is a schematic perspective view of an illustrative example of a firearm support device 100, which may be described as a vise block and/or a vise rod. FIG. 2 is a plan view of firearm support device 100, and FIG. 3 is a side view of the same. Device 100 can include an elongate member 102 having a long axis 104. Elongate member 102 can include a clamping portion 106 that can be structured and configured to be clamped between jaws of a bench vise. For example, clamping portion 106 can include two parallel clamping faces 108 on opposite sides of the clamping portion with curved sides between the clamping faces. The clamping portion also can define a plurality of vise pin holes 110. As indicated in FIG. 3 by phantom lines extending through clamping portion 106, pin holes 110 can be through-holes extending between opposing clamping faces 108, but this is not required in all examples, and in some embodiments, one or more vise pin holes can be blind holes.

Figure 4:
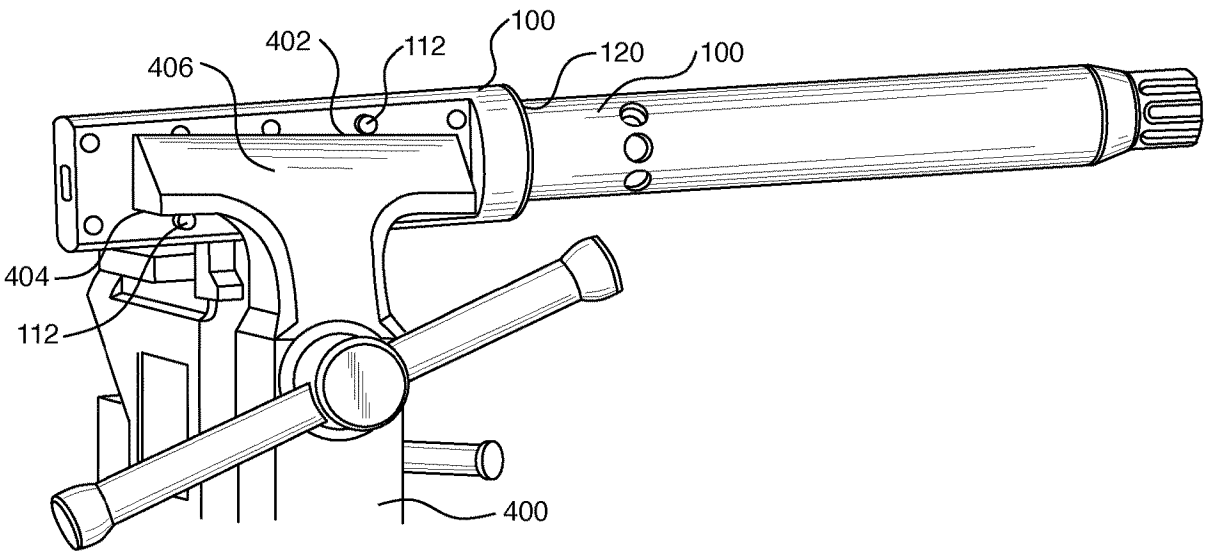
FIG. 4 is a schematic perspective view of the firearm support device of FIG. 1 clamped in a table vise.

Firearm support device 100 can include one or more vise pins 112 structured and configured to be received by any of the plurality of vise pin holes 110 of clamping portion 106, such that the vise pins are elongate and cylindrical in form and the vise pin holes are similarly shaped and dimensioned to enable a friction fit. More specifically, the external circumference of vise pins 112 may be substantially equivalent, albeit slightly smaller, to the internal circumference of vise pin holes 110. FIG. 4 is a schematic perspective illustration of firearm support device 100 clamped in a table vise 400. When received by suitable vise pin holes 110, the vise pins 112 can be positioned to bear against upper 402 and lower surfaces 404 of jaws 406 of a vise. So positioned, the vise pins 112 can serve to define and to assist in maintaining a working angle for firearm support device 100.

The elongate portion 102 of firearm support device 100 can include a supporting portion 114 structured and configured to provide support to an upper receiver of a firearm. Supporting portion 114 can include a generally cylindrical shaft 116 aligned with the long axis 104 of the elongate member 102 and in line with clamping portion 106, as illustrated in FIG. 1. Cylindrical shaft 116 can be shaped, structured, and configured such that an upper receiver of a rifle, which can be an AR-15 type rifle, can readily be slidingly engaged with the shaft via the rear opening of the upper receiver, and once the upper receiver is engaged with the cylindrical shaft, the shaft can provide robust support to the receiver.

Figure 5:
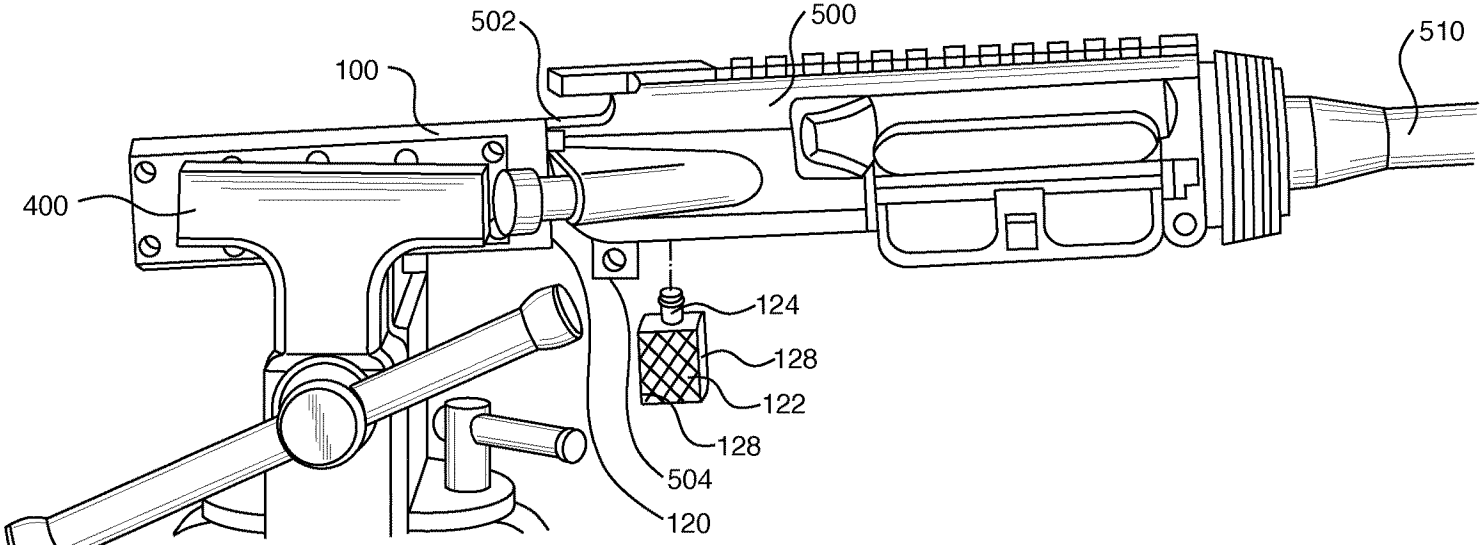
FIG. 5 is a schematic perspective view of the firearm support device of FIG. 1 clamped in a table vise, with an upper receiver engaged with the device.

Firearm support device 100 can include multiple features that can constrain and control the position of an upper receiver engaged with the device. FIG. 5 is a schematic perspective illustration of firearm support device 100 clamped in a table vise 400, with an upper receiver 500, which can be an AR-15 type upper receiver, engaged with supporting portion 114 of elongate portion 102 of the device. (In FIG. 5, upper receiver 500 is shown attached to a barrel 510 of the firearm, with only a portion of the barrel being shown in the drawing.)

Elongate portion 102 of firearm support device 100 can include a stop portion 118 located between and structurally connecting clamping portion 106 and supporting portion 114. Stop portion 118 can include a generally-planar upper receiver stop face 120 that can face supporting portion 114 and can be perpendicular to the long axis 104 of elongate member 102. Upper receiver stop face 120 can be configured to prevent translation of upper receiver 500 toward the clamping portion 106 of the device 100 (that is, it can limit sliding of the upper receiver "down" (toward) the clamping portion and the vise in which the clamping portion would be clamped while in use) when a back side 502 of the upper receiver bears against upper receiver stop face 120. Stop portion 118 can also provide a barrier at the end of clamping portion 106 that is closest to supporting portion 114, effectively keeping jaws 406 of a vise 400 separated from upper receiver 500. This barrier may be a continuation of the curved sides of stop portion 118, which project out further than the clamping faces 108 of clamping portion 106, as illustrated in FIG. 3. Stop portion 118 can include curved sides generally concentric with the curved sides of supporting portion 114, but this is not necessary and other shapes for the stop portion are possible. Stop portion 118 can include one or more flat faces 119 to counter undesired rolling of firearm support device 100, when the device is placed alone, for example, on a flat surface.

Motion of upper receiver 500 in the opposite direction (that is, sliding "up" and away from clamping portion 102) can be constrained by lock knob 122 of firearm support device 100. Lock knob 122 can generally have the same shape as clamping portion 106, such that it includes parallel faces 128 on opposite sides of the lock knob and curved sides that align with the curved sides of the clamping portion, as illustrated in FIGS. 2-3. Further, lock knob 122 can include a boss 124 structured and configured to be received by any of a plurality of radially-aligned lock knob holes 126 defined by, and located circumferentially around, the cylindrical shaft 116 of supporting portion 114. Boss 124 and lock knob holes 126 may be cylindrical in shape, but this shape is not limiting, and other shapes are possible, such as pyramidal or cuboids. Lock knob holes 126 can be provided every 45 degrees about the circumference of cylindrical shaft 116, but this is not limiting, and any suitable angular distribution of holes is possible.

Lock knob holes 126 can be blind holes, as illustrated, or, in other embodiments, through holes. Lock knob holes 126 can be located at substantially identical distances from upper receiver stop face 120, such that when the back side 502 of the upper receiver 500 bears against the upper receiver stop face, and when boss 124 of lock knob 122 projects through the opening on the underside of the upper receiver (not visible in FIG. 5) and is received by one of the lock knob holes, the lock knob is positioned to prevent translation of the upper receiver away from the clamping portion of the device. In this position, a face 128 of lock knob 122 can be positioned to interfere with a takedown pin receptacle tab 504 of upper receiver 500, thereby preventing forward translation of the upper receiver relative to device 100. In FIG. 5, lock knob 122 is depicted before it is put into place to prevent translation of upper receiver 500, but aligned for such placement, as suggested by the dashed line between boss 124 and the receiver.

Figure 7:
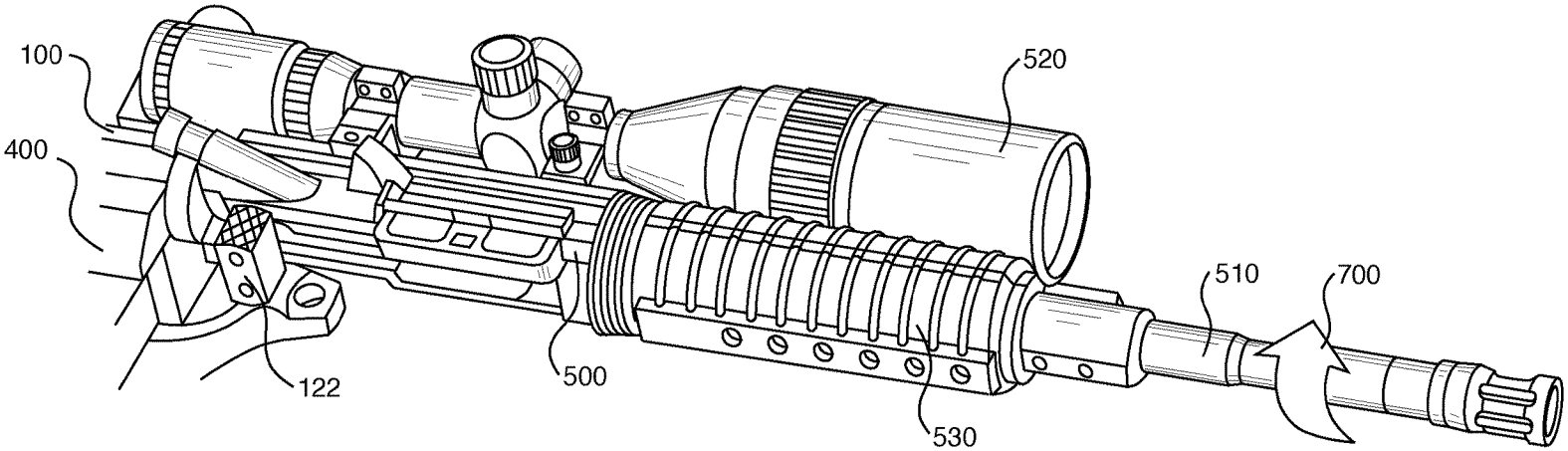
FIG. 7 is schematic perspective view of connected components of a rifle engaged with the firearm support device of FIG. 1, with the components rotated relative to the orientation of FIG. 5.

FIG. 7 is another schematic perspective illustration of connected components of a rifle engaged with firearm support device 100. The rifle components can include upper receiver 500, barrel 510, a sight 520, handguard 530, and other components not explicitly called-out. In FIG. 7, upper receiver 500 is illustrated as being rotated about 90 degrees (in the direction of arrow 700) relative to the position of the upper receiver shown in FIG. 5. The angular distribution of lock knob holes 126 about the cylindrical shaft 116 provide a variety of positions for placement of lock knob 122, thereby providing the ability to support components of the firearm at a variety of rotational positions, according to the preference of the user, which may depend on a maintenance task being performed.

Firearm support device 100 can be structured and configured to provide self-storage for its components. The end of clamping portion 106 can define or include a lock knob storage bore 134 (indicated in phantom lines in FIG. 2), which can be a blind hole, that is sized to securely receive boss 124 of lock knob 122. Boss 124 can include any suitable feature(s) to promote retention in lock knob storage bore 134 and/or lock knob holes 126, such as one or more o-rings 136 (as illustrated) and/or a detent mechanism (not illustrated). In some cases, lock knob storage bore 134, similar to lock knob holes 126, may be cylindrical in shape to correspond to the cylindrical shape of boss 124.

For storage of vise pins 112, lock knob 122 can define or include vise pin storage bores 138 (indicated in phantom lines in FIG. 2), which can be blind holes, that are sized to securely receive vise pins 112. Vise pins 112 can include any suitable feature(s) to promote retention in vise pin storage bores 138 and/or vise pin holes 110, such as one or more o-rings (not illustrated) and/or a detent mechanism 140 that enables a friction fit. As with vice pin holes 110, vise pin storage bores 138 may be elongate and cylindrical, similar to the shape and dimension of vise pins 112, and may have an internal circumference that is substantially equivalent to, albeit slightly larger than, the external circumference of vise pins, which can help to enable a friction fit.

Firearm support device 100 can be configured to provide robust support to firearm components when performing maintenance tasks that involve torque about the long axis 104 of the device and firearm components mounted thereto. Examples of such maintenance tasks include securing/removing a barrel to/from an upper receiver by torqueing a barrel nut, which can involve large torques, and attaching/detaching barrel accessories such as flash suppressors. Compared with alternative support devices that can clamp an upper receiver externally and potentially subject the upper receive to damage from excessive forces, firearm support device 100 can support firearm components internally where some of the strongest components of the firearm are located.

Figure 6:
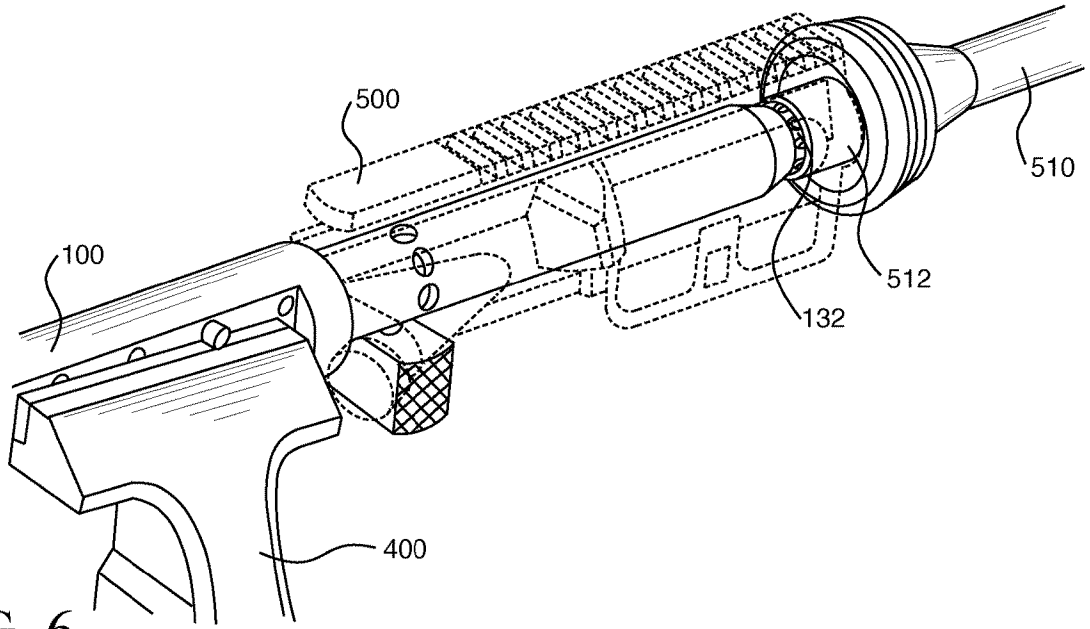
FIG. 6 is a schematic perspective view of the firearm support device of FIG. 1 clamped in a table vise, with an upper receiver and a barrel engaged with the device.

More specifically, supporting portion 114 of elongated portion 102 can include, at a barrel end 130 of the supporting portion, a plurality of splines 132 structured and configured to mate with lugs of a barrel extension (i.e., lugs of the "star chamber") of a barrel of the firearm. FIG. 6 is a schematic perspective illustration of firearm support device 100 clamped in a vise 400 and engaged with an upper receiver 500 (outlined in phantom) and a barrel 510 of a firearm. The barrel end 130 of supporting portion 114 is illustrated as protruding into a barrel extension 512 of barrel 510, with splines 132 being engaged with complementary interior lugs (not visible) of the barrel extension. Torques applied to barrel nuts and barrel accessories are balanced by reaction torques imparted to firearm components by firearm support device 100 via splines 132 at the star chamber lugs of the barrel extension 512.

Persons of ordinary skill in arts relevant to this disclosure and subject matter hereof will recognize that embodiments may comprise fewer features than illustrated in any individual embodiment described by example or otherwise contemplated herein. Embodiments described herein are not meant to be an exhaustive presentation of ways in which various features may be combined and/or arranged. Accordingly, the embodiments are not mutually exclusive combinations of features; rather, embodiments can comprise a combination of different individual features selected from different individual embodiments, as understood by persons of ordinary skill in the relevant arts. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is intended also to include features of a claim in any other independent claim even if this claim is not directly made dependent to the independent claim.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of Section 112, sixth paragraph of 35 U.S.C. are not to be invoked unless the specific terms "means for" or "step for" are recited in a claim.

What is claimed is:

1. A firearm support device, comprising:

an elongate member having a long axis, the elongate member including:

a clamping portion at a first end of the elongate member, the clamping portion structured and configured to be clamped between jaws of a bench vise, the clamping portion including two parallel clamping faces on opposite sides of the clamping portion; and a supporting portion at a second end of the elongate member opposite the first end, the supporting portion structured and configured to provide support to an upper receiver of a firearm, the supporting portion including a generally cylindrical shaft aligned with the long axis of the elongate member, the supporting portion further including, at a barrel end of the supporting portion, a plurality of splines structured and configured to mate with lugs of a barrel extension of a barrel of the firearm; and at least two vise pins that cooperate with the clamping portion.

2. The firearm support device of claim 1, wherein:

the clamping portion defines a plurality of vise pin holes; and the at least two vise pins are structured and configured to be received by any of the plurality of vise pin holes of the clamping portion.

3. The firearm support device of claim 2, further comprising a stop portion located between and structurally connecting the clamping portion and the supporting portion, the stop portion including a generally-planar upper receiver stop face that faces the supporting portion and is perpendicular to the long axis of the elongate member, the upper receiver stop face configured to prevent translation of the upper receiver toward the clamping portion of the device when a back side of the upper receiver bears against the upper receiver stop face.

4. A firearm support device, comprising:

an elongate member having a long axis, the elongate member including:

a clamping portion at a first end of the elongate member, the clamping portion structured and configured to be clamped between jaws of a bench vise, the clamping portion including two parallel clamping faces on opposite sides of the clamping portion; and a supporting portion at a second end of the elongate member opposite the first end, the supporting portion structured and configured to provide support to an upper receiver of a firearm, the supporting portion including a generally cylindrical shaft aligned with the long axis of the elongate member, the supporting portion further including, at a barrel end of the supporting portion, a plurality of splines structured and configured to mate with lugs of a barrel extension of a barrel of the firearm, the supporting portion further defining a plurality of lock knob holes aligned radially and located circumferentially around the generally cylindrical shaft; and a lock knob, the lock knob including a boss structured and configured to be received by any of the plurality of lock knob holes located around the shaft of the supporting portion, wherein the lock knob holes are located at substantially identical distances from the barrel end of the support portion, such that when the boss of the lock knob projects through an opening on the underside of the upper receiver and is received by one of the lock knob holes, the lock knob is positioned to prevent translation of the upper receiver toward the barrel end of the firearm support device.

5. The firearm support device of claim 1, further comprising a lock knob, the lock knob including a boss structured and configured to be received by any of a plurality of lock knob holes located around the shaft of the supporting portion, wherein:

the supporting portion of the elongate member further defines the plurality of lock knob holes aligned radially and located circumferentially around the generally cylindrical shaft; and the lock knob holes are located at substantially identical distances from the barrel end of the support portion, such that when the boss of the lock knob projects through an opening on the underside of the upper receiver and is received by one of the lock knob holes, the lock knob is positioned to prevent translation of the upper receiver toward the barrel end of the device.

6. The device of claim 5, further comprising a stop portion located between and structurally connecting the clamping portion and the supporting portion, the stop portion including a generally-planar upper receiver stop face that faces the supporting portion and is perpendicular to the long axis of the elongate member, the upper receiver stop face configured to prevent translation of the upper receiver toward the clamping portion of the device when a back side of the upper receiver bears against the upper receiver stop face.

7. A firearm support device, comprising:

an elongate member having a long axis, the elongate member including:

a clamping portion structured and configured to be clamped between jaws of a bench vise, the clamping portion including two parallel clamping faces on opposite sides of the clamping portion;

a supporting portion structured and configured to provide support to an upper receiver of a firearm, the supporting portion including a generally cylindrical shaft aligned with the long axis of the elongate member, the supporting portion further including, at a barrel end of the supporting portion, a plurality of splines structured and configured to mate with lugs of a barrel extension of a barrel of the firearm; and a stop portion located between and structurally connecting the clamping portion and the supporting portion, the stop portion including a generally-planar upper receiver stop face that faces the supporting portion and is perpendicular to the long axis of the elongate member, the upper receiver stop face configured to prevent translation of the upper receiver toward the clamping portion of the device when a back side of the upper receiver bears against the upper receiver stop face.

8. The device of claim 7, further comprising a lock knob having a boss, wherein the supporting portion defines a plurality of lock knob holes structured and configured to receive the boss, the lock knob holes being aligned radially and located circumferentially around the generally cylindrical shaft, lock knob holes further being located at substantially identical distances from the upper receiver stop face, such that when the back side of the upper receiver bears against the upper receiver stop face, and when the boss of the lock knob projects through an opening on the underside of the upper receiver and is received by one of the lock knob holes, the lock knob is positioned to prevent translation of the upper receiver away from the clamping portion of the device.

9. The device of claim 7, further comprising at least two vise pins, wherein the clamping portion defines a plurality of vise pin holes, the vise pin holes each being structured and configured to receive one of the at least two vise pins.

10. A firearm support device, comprising:

an elongate member having a long axis, the elongate member including:

a clamping portion structured and configured to be clamped between jaws of a bench vise; the clamping portion including two parallel clamping faces on opposite sides of the clamping portion, the clamping portion defining a plurality of vise pin holes;

a supporting portion structured and configured to provide support to an upper receiver of a firearm, the supporting portion including a generally cylindrical shaft aligned with the long axis of the elongate member, the supporting portion further including, at a barrel end of the supporting portion, a plurality of splines structured and configured to mate with lugs of a barrel extension of a barrel of the firearm, the supporting portion further defining a plurality of lock knob holes aligned radially and located circumferentially around the generally cylindrical shaft; and a stop portion located between and structurally connecting the clamping portion and the supporting portion;

a lock knob, the lock knob including a boss structured and configured to be received by any of the plurality of lock knob holes located around the shaft of the supporting portion; and at least two vise pins structured and configured to be received by any of the plurality of vise pin holes of the clamping portion.

11. The device of claim 10, wherein the stop portion includes a generally-planar upper receiver stop face that faces the supporting portion and is perpendicular to the long axis of the elongate member, the upper receiver stop face configured to prevent translation of an upper receiver toward the clamping portion of the device when a back side of the upper receiver bears against the upper receiver stop face.

12. The device of claim 11, wherein the lock knob holes are located at substantially identical distances from the upper receiver stop face, such that when the back side of the upper receiver bears against the upper receiver stop face, and when the boss of the lock knob projects through an opening on the underside of the upper receiver and is received by one of the lock knob holes, the lock knob is positioned to prevent translation of the upper receiver away from the clamping portion of the device.

* * * * *